United States Patent [19]

Peppers

[11] Patent Number: 4,843,827

[45] Date of Patent: Jul. 4, 1989

[54] METHOD AND APPARATUS FOR MAKING ICE BLOCKS

[76] Inventor: James M. Peppers, P.O. Box 20-0038, Arlington, Tex. 76006-0038

[21] Appl. No.: 263,694

[22] Filed: Oct. 28, 1988

[51] Int. Cl.[4] ..... F25C 5/10

[52] U.S. Cl. ..... 62/73; 62/352; 62/353; 249/70; 425/436 R

[58] Field of Search ..... 62/73, 352, 71, 72, 62/353; 249/66.1, 69–71; 425/436 R

[56] References Cited

U.S. PATENT DOCUMENTS 2,613,511 10/1952 Walsh ..... 62/72
2,683,359 7/1954 Green, Jr. ..... 62/353 X
3,411,309 11/1968 Skrewbowski et al. ..... 62/71 X
4,474,023 10/1984 Mullins, Jr. ..... 62/352 X
4,694,656 9/1987 Lane et al. ..... 62/347 X
4,708,621 11/1987 Schmidzall et al. ..... 425/436 R X

*Primary Examiner*—William E. Tapolcai
*Attorney, Agent, or Firm*—James E. Bradley

[57] ABSTRACT

A repetitive ice block or cube maker in which chilled water flows over a vertical evaporator to form ice blocks within ice freezing pockets of designated shape. The ice blocks are positively released by concurrently heating the evaporator while inducing a designated vibration in the evaporator. The vibration may be of sonic or ultrasonic frequency. A breather vacuum breaker vent may be provided in the bottom of each ice pocket. Each ice block is released with a minimum of heat being developed while heating the evaporator.

11 Claims, 2 Drawing Sheets

METHOD AND APPARATUS FOR MAKING ICE BLOCKS

BACKGROUND OF THE INVENTION

This invention generally relates to methods and apparatus for making large quantities of block or cubed ice. More particularly, this invention pertains to a method and apparatus for making cubed ice which is "dry" for placement into storage at subfreezing temperatures.

This invention is an improvement to methods and apparatus such as disclosed in Lane et al U.S. Pat. Nos. 4,688,386 and 4,694,656. The nearest known prior art to the present invention are the Lane et al patents. As background, the Lane et al patents are specifically incorporated herein by reference. Other prior art is Geyer U.S. Pat. No. RE. 20,656; Knowles U.S. Pat. No. 2,616,271; Kattis U.S. Pat. No. 3,144,755; Dedricks et al U.S. Pat. No. 3,430,452; Solomon U.S. Pat. No. 3,929,256; Lee et al U.S. Pat. No. 4,549,408; Ohashi et al U.S. Pat. No. 4,589,264; and Povajnuk U.S. Pat. No. 4,590,774.

The Lane et al patents disclose apparatus including a plurality of vertically disposed ice freezing pockets which are formed with the wall of a refrigeration evaporator. A reverse cycle refrigeration means is disclosed to alternately freeze the evaporator and heat the evaporator. Chilled water is made to flow over the openings of the pockets until the pockets fill with ice. Vertical plates are urged from a first position horizontally toward a second position until immediate surfaces are melted during the heat cycle. Thereafter the plates move from the first to a second position to move the ice blocks within the pockets and free the ice blocks which will drop into a storage bin below. The two Lane et al patents are very similar with one of the patents disclosing an evaporator which is circular and the other of the patents disclosing an evaporator which is linear.

The drawbacks to the Lane et al apparatus are that a number of solenoids and mechanical linkages and moving parts are required all of which are subject to adjustment, wear. While the Lane apparatus is in improvement over the other cited prior art, the present invention is considered to be in substantial improvement over the Lane et al apparatus. The present invention needs none of such linkages and operates thermodynamically with a better ratio of freezing time versus cube release heating time.

The present invention has several features which are significant for an improved ice machine and method.

The conventional cooling/heating reverse cycle of the refrigerating system causes the refrigerant to heat very rapidly in the freezing evaporator and consequently heat the ice cube pocket very rapidly to very rapidly form a progressively thicker film of water between an ice cube pocket and a frozen ice cube.

Also, the vertical bottom of each pocket is effectively in direct thermal contact with the refrigerant during the freezing cycles and the release cycles.

The new features are:

The angle of the walls of each pocket are greater than 90 degrees with respect to the bottom of each pocket to permit easy release of an ice cube at the instant that any film of water is formed to serve as a lubricant between the ice cube pocket and the ice cube.

The vibration induced in the pocket by the transducer instigates movement and agitation between the pocket and the ice cube at the instant that any bond between the ice cube pocket and the ice cube is reduced or eliminated.

A breather vacuum breaking vent appropriately located in each ice cube pocket lets air pressure into and behind the frozen ice cube for permitting release of the ice cube from the pocket much sooner than if the necessary air had to enter along the sides of the ice cube to get in past the developed water film.

Providing the cooling/heating refrigerant directly in the spaces between the ice cube pocket walls in addition to the bottom of the ice cube pocket causes the apparatus to be thermodynamically much more responsive to the heating/cooling cycle.

OBJECTS OF THE INVENTION

An important object of this invention is to provide an integrated ice cube freezing evaporator apparatus having no moving ice cube release mechanisms or linkages;

Another object of the present invention is to make ice cubes delivered at subfreezing temperatures for use or storage;

Yet another object of the present invention is to provide an ice cube making apparatus and method which will maintain a repeating freezing/release cycle that will attain a maximum total time for making ice cubes and a comparative minimum total time for releasing the completely frozen ice cubes; and Yet another object of the present invention is to provide an ice cube making apparatus which is comparatively less expensive to build and maintain than disclosed in the prior art.

OBJECTS OF THE INVENTION

The foregoing and other objects of the invention are attained in a method for making discrete blocks of ice which includes the steps of flowing chilled water over the openings of a plurality of vertically disposed ice freezing pockets. Each of the pockets are formed with flat walls on a side of a freezing evaporator as the base of each pocket of said pockets and with horizontally and vertically spaced apart fins formed with the base and inclined to flare outwardly more than 90 degrees from the base to cause the opening of each of the pockets to be larger than said base of said pocket. A breather vent means is in communication between each of the flat walls and the pockets. The chilled water is allowed to come into contact with the base and the fins to freeze and build up ice to fill the pockets and form ice blocks during a designated time period. The evaporator side walls, the base and the fins are to be heated for a designated time period to melt and develop a water film on the immediate surfaces between the blocks and the pockets. Air is allowed to come into the rear of the pocket and permit the ice block to slide free out of the pocket without the hindrance of a vacuum at the base of the pocket. The freezing cycle is resumed. The method includes the step of concurrently vibrating the evaporator while heating the evaporator. The vibrating step may be at subsonic frequency or at ultrasonic frequency. The above method may also be supplemented by a step of introducing air under pressure through the breather vent during the heating step.

The invention also includes apparatus including a plurality of ice freezing pockets which are formed with the walls of a refrigeration evaporator as the base of said pockets. Horizontally and vertically spaced apart fins are formed with the base of each pocket to extend outwardly at an angle to cause the opening of each pocket to be larger than the base of each pocket and creating a common cavity or space between adjoining pockets. An appropriate part of each said base forms a breather vent which is in communication with the space between the adjacent walls. A refrigeration apparatus is provided for freezing the base and the sides of the pocket. Apparatus is provided for circulating chilled water over the openings of the pockets. No apparatus is provided for running the refrigeration means through a freezing cycle sufficient to allow the chilled water coming into contact with the base and said the sides to freeze and build up as ice to fill said pockets and form ice blocks and for operating the refrigeration means through a heating cycle sufficient only to develop a water film on the immediate surfaces between the block and the pocketed. Air pressure through the vent breather vent breaks the vacuum formed behind each ice and causes the ice block to be released from the pocket. A vibrating transducer operating at either subsonic vibration or ultrasonic vibration is advantageously used in connection with the heating cycle to more quickly release each ice cube.

DESCRIPTION OF A PREFERRED EMBODIMENT

Figure 1:
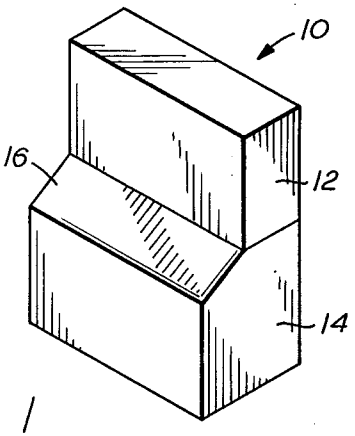
FIG. 1 generally illustrates an ice machine suitable for manufacturing ice blocks or cubes and storing such cubes until used.

FIG. 1 illustrates schematically an ice cube making apparatus 10 having an ice making compartment 12 disposed above an ice cube storage box 14. Access cover 16 provides entry into the storage box 14. An ice cube freezing evaporator 18, as shown in FIG. 2, may be mounted in the ice making compartment 12.

Figure 2:
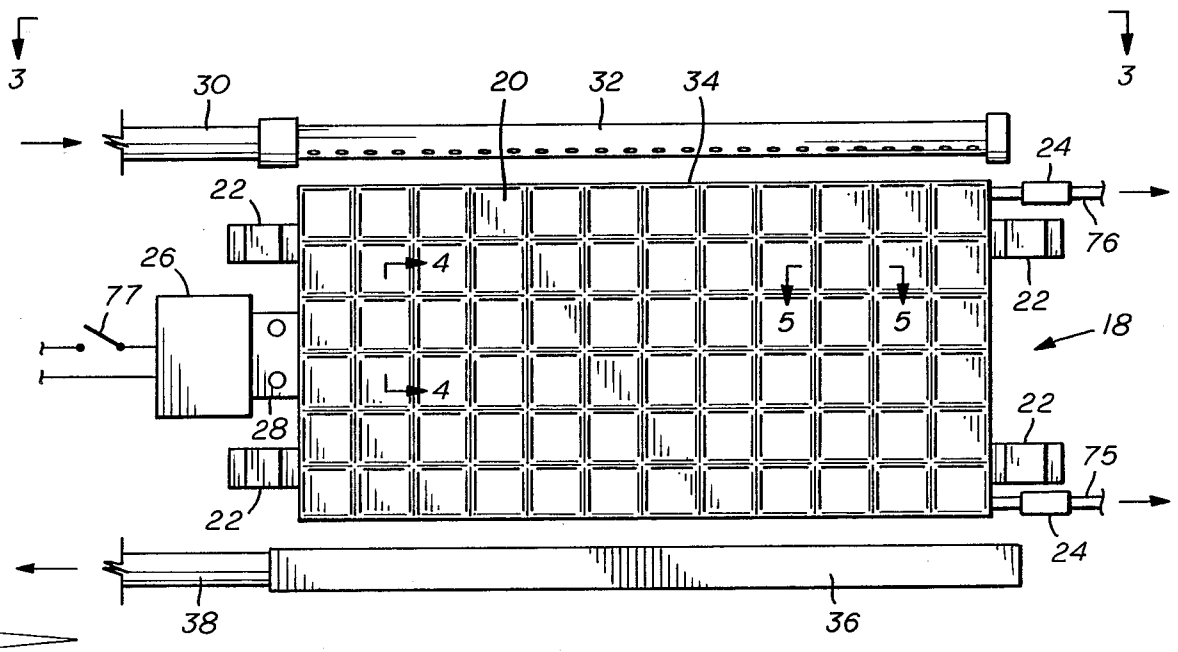
FIG. 2 is a side elevational and schematic view of an ice freezing machine unit and more particularly an ice freezing evaporator.
Figure 3:
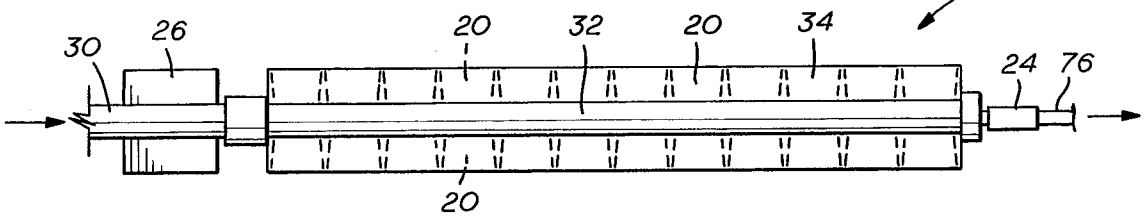
FIG. 3 is a plan view of the freezer unit of FIG. 2.

The ice cube freezing evaporator 18 is best shown in FIGS. 2 and 3. The evaporator 18 is seen to include a plurality of ice cube freezing compartments or pockets 20 formed on both sides of the evaporator. As shown the evaporator 18 is provided with 72 freezing pockets 20 on each side of the evaporator 18, or a total of 144 pockets. It is noted that the pockets 20 can be provided on one side only if desired. Also noted is that the evaporator 18 can be substantially larger, or smaller, as desired.

Figure 7:
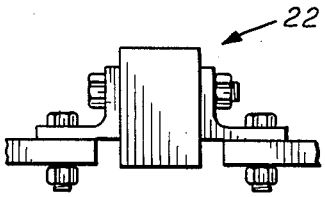
FIG. 7 is an elevational view showing the detail of a vibration isolation mount utilized to mount the freezing evaporator.

The evaporator 18 is mounted as within compartment 12 with four conventional vibration isolation couplers 22 which are typically shown in FIG. 7.

Figure 8:
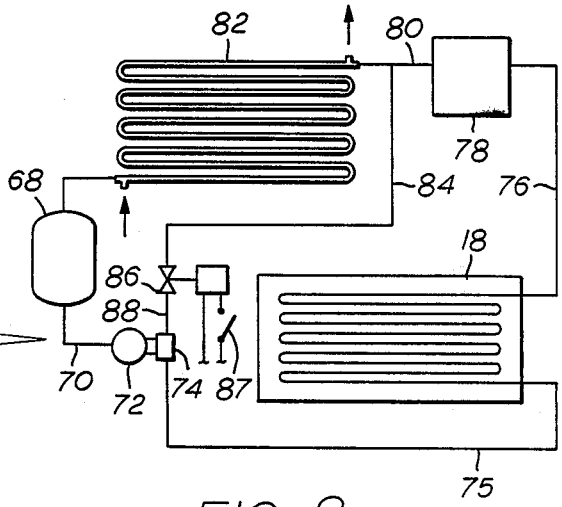
FIG. 8 is a schematic illustration of a refrigeration apparatus used in the present invention which is capable of the reverse cycle used in the present invention for rapidly heating, then cooling, the freezing evaporator shown in FIGS. 2 and 3.

The inlet and outlet refrigerant conduits of the evaporator 18 are coupled to lines conduit 75 and 76 of the refrigeration system shown in FIG. 8 through conventional vibration isolation conduit couplers 24 as shown in FIG. 2.

A vibration transducer 26 is coupled to the evaporator 18 by means of a mechanical coupler 28 which may be conventional, or special as later described. The transducer 26 is electrically actuated and the switch 77 is shown to energize or de-energize the transducer as desired.

A chilled water circulation system including a circulating pump (not shown) is connected through a pipe 30 to a water distribution pipe 32. Pipe 32 has an even distribution of holes along its length which allow passage of an even flow of water down onto a flow distribution plate 34 which evenly carries the flow of water along the top edge of the evaporator 18 into successive contact with fins 40 of the evaporator as later described and on into a sump 36 which empties into a pipe 38 back into the circulation system.

Figure 4:
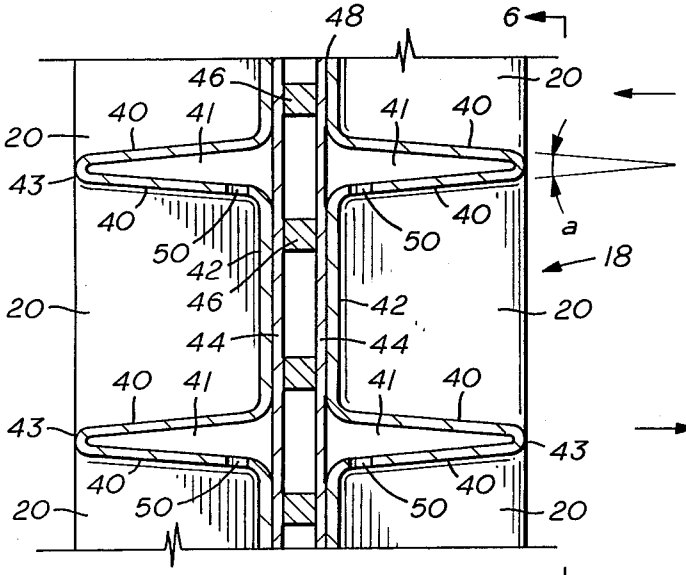
FIG. 4 is an enlarged dross sectional view of the freezing evaporator as taken along the line 4—4 of FIG. 2.
Figure 5:
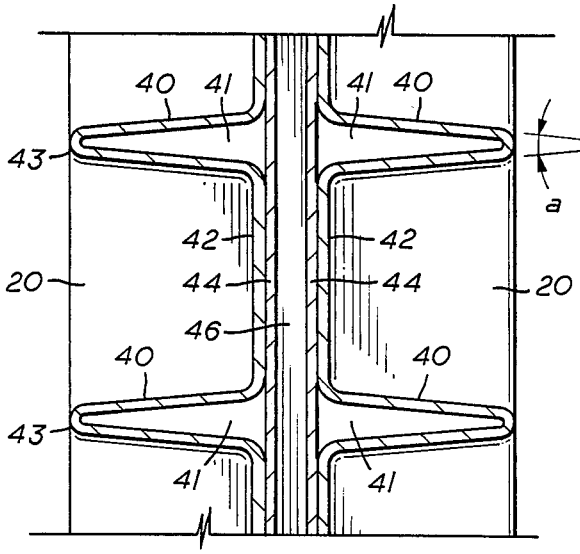
FIG. 5 is an enlarged cross sectional view of the freezing evaporator of FIG. 2 as taken along the line 5—5 of FIG. 2.
Figure 6:
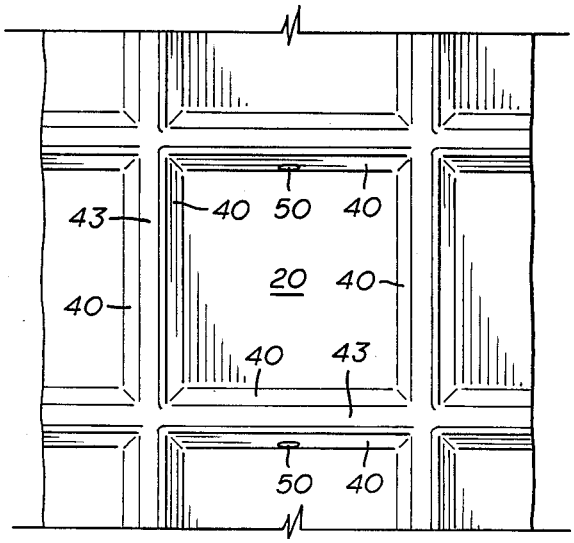
FIG. 6 is a side elevation of the freezing evaporator as taken along the line 6—6 of FIG. 4.

It is to be noted, with reference to FIGS. 4, 5 and 6, that the freezing compartments or pockets 20 are formed by the evaporator pocket fins 40 to form a hollow cavity 41 between the fins. The fins 40 flare outwardly from the base or bottom 42 to form apexes 43 as shown. As also shown, the included angle a of each of the apexes 43 may be about 15 degrees, more or less. The criteria here is for the walls 40 to be slightly greater than 90 degrees with respect to the pocket bottom or base 42.

The evaporator 18 is formed with horizontal ribs 46 connected with evaporator walls 44 which is in turn connected with the freezer pocket bottoms or bases 42. As with the prior art, this evaporator 18 may be formed by pressing the pockets 20 from a sheet into the shape as shown and soldering the whole assembly together including the base 42, the horizontal ribs 46, and the evaporator walls 44 with a soldering material such as silver solder, "SILFOS" or other conventional brazing solders in present use.

Referring further to FIGS. 4, 5 and 6, each of the pockets 20 are formed with side walls or fins 40 formed from pocket bottoms or bases 42 to form fin cavities 41 and to terminate with apexes 43 as shown. As previously mentioned, the walls or fins 40 extend from the bases 42 at an angle somewhat greater than 90 degrees such that the apex angles are about 15 degrees.

The inner surfaces of the freezing pockets 20 are finished to be even and smooth, such as to a "polish" finish.

In FIGS. 4 and 6, it is noted that each of the pockets 20 has a breather vent 50 formed in an upper wall 40 adjacent the base 42. The vent communicates the pocket 20 with the cavity 41. As shown with reference to FIGS. 2 and 4, the cavity 41 extends vertically and horizontally throughout the evaporator 18 and is vented to atmospheric pressure in this embodiment. As later described with reference to operation of the apparatus, this vent is expected to be plugged up with ice during the ice forming cycle of the machine. However, the ice in this vent will be the first to thaw into a liquid for drainage during the heating cycle of the machine.

Figure 4A:
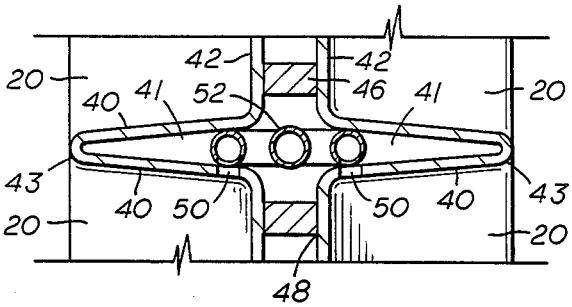
FIG. 4A is a view also taken along the line 4—4 and showing an enlarged cross section of an alternate embodiment of a freezer evaporator.

An alternate embodiment of the evaporator in FIG. 4 is shown in FIG. 4A. In this embodiment the vents 50 are connected into an exhaust tube or multiplicity of tubes 52 which are routed out of the evaporator 18 in sealed relation with respect to the cavities 41. In this embodiment the evaporator walls 44 could be deleted and the bases 42 of the pockets 20 then soldered directly to the ribs 46. While this structure is operable, it is noted that the walls 44 can be provided also as a perforated screen such that the refrigerant within the walls 44 now extends out into the cavities 41 to the apexes 43 as shown. This structure makes the evaporator 18 much more quickly responsive to the change between the cooling cycle and heating cycle as later described. Also, with evaporating refrigerant in the cavities 41, the evaporator 18 will much more quickly build up complete ice blocks during the freezing cycle and require a shorter freezing cycle to make a designated amount of ice.

The vents 50 located in each pocket 20 are significant in allowing each ice block to be released from its pocket 20 with a very minimum of water film generated between the ice block and the walls of pocket 20 during the heating cycle. Initial movement of the ice block from the cavity or pocket 20 will create a vacuum in the space along the pocket base 42 which will hold the ice cube into place until air is introduced to relieve or break the vacuum. If the clearance between the walls 40 and the ice cube is used to admit atmospheric pressure to behind the ice cube, then the ice cube must be melted sufficiently to allow air to come in as water drains out. This requires a much longer time period for the ice cube to be released down the very slight incline of a wall 40 and for the overall temperature of the ice cube (as a whole) to be raised substantially before the ice cube is released. In the prior art, the entire ice cube temperature is raised to very nearly freezing temperature before such release occurs.

The vent 50 thereby breaks the vacuum tending to be created along the pocket base 42 and allows exit of the ice cube at the very instant that sufficient heat has been created to free the cube. Ice is a comparatively poor conductor of heat. In another perspective, ice is a comparatively good heat insulator. Consequently, the quicker that an ice cube is freed from its pocket and moves out of the pocket, then the less heat is absorbed into the ice cube.

As shown in FIG. 4A, the vents 50 are connected through a breather pipe 52 and will work the same as with the cavities 41 in FIG. 4. It is pointed out at this juncture that positive pressure above atmospheric pressure can be introduced through the vents 50 very easily by those skilled in the art. Such air pressure would need be provided by some source (not shown) such as a simple diaphragm compressor.

The vibration transducer 26 may be conventional and purchased from suppliers. For example, a very rugged magneto-strictive transducer operating at 20 Khz is manufactured by Lewis Corporation, Oxford, Conn. 06483. The Lewis transducer is normally used with ultrasonic cleaning apparatus. Another transducer operating at 20 Khz is manufactured by "Sonic-Mill" Albuquerque, Division of Rio Grande Albuquerque, Inc., 3820 Academy Parkway North, N.E., Albuquerque, N.M. 87109. The Sonic-Mill is an ultrasonic machining device. Another "Magna Pack" ultrasonic vibration generator is manufactured by Westinghouse Electric Corporation, Ultrasonic Cleaning Products, 1201 North Main Street, Orrville, Ohio 44667.

These ultrasonic vibration transducers usually require a custom coupling to couple the same to evaporator 18 and need to be custom made to fit with this application by the ultrasonic transducer manufacturers.

Another suitable and more conventional vibration transducer, operating at 3.6 Khz is available from Eriez Magnetics, Erie, Pa. 16514. The Eriez vibrating transducers are commonly applied as bin vibrators for unloading bins, chutes, hoppers and the like. Eriez makes a small noiseless series in the Models 20N-30N which operate on AC voltage at about 20 to 40 watts. Eriez and others make quite larger vibrators as may be needed for larger evaporators.

The vibrator 26 as disclosed will vibrate the evaporator 18 back and forth in a horizontal direction. The application could be modified for the evaporator 18 to be vibrated in a vertical direction, or even transverse direction. Any direction will be operable.

Again referring to FIGS. 4–6 the vibrator 26 is expected to vibrate evaporator 18 through a distance of only about 1/1000ths to about 25/1000ths of an inch, for example. Such vibration will agitate the ice cubes in each of the pockets 20 during the heating cycle of evaporator 18. Each ice cube will be rocked in relation to the movement of pocket 20 to cause the release of the ice cube from the pocket 20 as soon as the bond between the ice cube and the pocket is sufficiently weakened.

The amplitude of vibration of evaporator 18 is controlled to a designated value (distance traveled) by selection of the transducer 26 and also selection of the effective stiffness of the vibration mounts 22. At ultrasonic frequencies this vibration would, of course, be imperceptible. In the lower sonic range of vibration, such as provided by the Eriez bin vibrators, the magnitude of vibration will be so small as to be almost imperceptible.

Of course, such small amplitudes of vibration will be well within the elastic limit of the vibrated metal parts and will not result in work hardening or fatigue.

Figure 9:
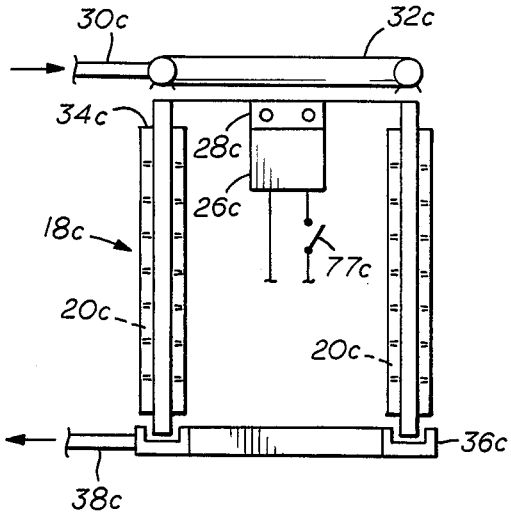
FIG. 9 is a schematic cross section of a circular freezing evaporator built in accordance with the present invention.
Figure 10:
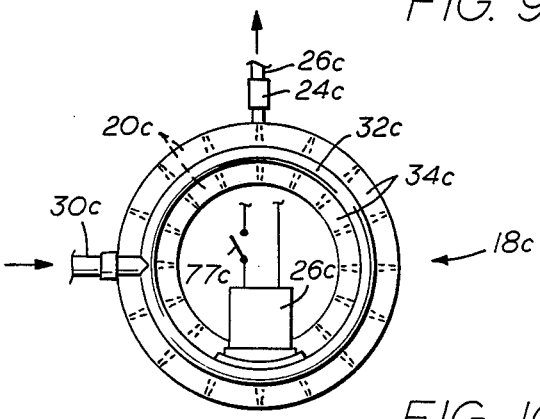
FIG. 10 is a plan view of the circular freezer evaporator shown in FIG. 9.

FIGS. 9 and 10 illustrate the same kind of evaporator 18 as shown in FIGS. 2 and 3, wherein the evaporator is provided in circular rather than linear form. For orientation, like elements are shown with like numbers with the suffix "c". In this embodiment the vibration transducer **26*c* may vibrate the evaporator 18*c*** either rotationally or vertically. The Eriez type bin vibrator will likely be the least expensive and most conveniently installed for this application. The series 20N weighs about six pounds with dimensions of 3 7/16"×7 $\frac{1}{2}$"×5$\frac{3}{8}$".

It is noted that the conventional items described herein can purchased directly. However, some items can be specially made for a particular size of the evaporator 18 and provide advantages in both cost and operation.

The refrigeration system is generally and schematically shown in FIG. 8 with the evaporator 18 and component parts being shown in FIGS. 2–6. As shown a liquid refrigerant "Freon-12" is stored in an accumulator 68 under pressure. The refrigerant is fed through a liquid line 70 through an expansion control valve 72 to a distributor header 74. From the distributor header 74 the refrigerant is fed through 75 and the conduit isolation joint 24 into the evaporator 18. The evaporator 18 feeds through another isolation joint 24 into a return suction line 76 and into the suction side of a compressor 78. The coupler isolation joints 24 are shown in FIG. 2. The refrigerant is compressed by the compressor 78 to a high pressure and high temperature and discharged through a discharge line 80 into a water cooled condenser 82 which condenses the hot gas back into a liquid which is drained into accumulator 68 for reuse.

A hot gas by-pass line 84 is connected from discharge line 80 through a normally closed solenoid valve 86 and a line 88 into the distributor header 74 as shown, or with an equivalent connection.

During a freezing cycle of the freezing evaporator structure 18, the refrigerating apparatus as shown in FIG. 8, operates normally with the walls 40 and 42 shown in FIGS. 4–6 freezing ice from the water. At a designated interval, 5–9 minutes for example, the solenoid 86 is actuated by switch 87, opening the valve and permitting hot gas to go from compressor 78 through the line 84 and line 88 directly into the header 74 and the walls 40, 44, 42 and of pockets 20 as shown.

There is little mass to be heated in the freezing evaporator structure 18 as shown in FIGS. 2–6, and FIGS. 9 and 10. The structure is rapidly heated up by this hot gas to the ice melting point of 32 degrees fahrenheit. The instant that the heated metal surfaces of the pockets 20 has melted the immediate surfaces of the ice block sufficient only to generate a very thin film of water between the surfaces of the ice block, then the water serves as a lubricant for sliding the ice block along the surfaces 40 of the pocket 20 and to release the ice from the surface base 42 of the ice block 20.

At this juncture the ice block will tend to slide down the slope of a wall 40. Also at this juncture, the vents 50 are providing atmospheric pressure behind the ice block to break the vacuum tending to hold the ice block within the pocket. These two factors of themselves will allow the ice block to be freed in a very short time.

Further, however, when the vibrations of transducer 26 are added to the previously mentioned release features, the ice cube is agitated around to start and to further promote the exit of the ice block from the pocket almost instantaneously. This movement may be imperceptible initially but even so promotes and enhances movement of each ice cube tending to exit the cube from the pocket.

It is pointed out that the vibration and created water film alone will serve to exit the ice cube from pocket 20 in a very short time interval. Also, the water film combined with the vacuum breaking feature behind the ice cube will serve to exit the ice cube from the pocket 20 in a very short time interval.

The combination of the heat generated water film, the action breaking action of the vent 50 and the vibration agitation provided by the transducer 26 all contribute to an extremely fast exit of each ice cube from its pocket 20.

The variable to be improved is the rate at which the heat is transmitted to the walls of the pocket 20 beginning with the reverse heating cycle of the refrigeration system. The embodiment as shown in FIG. 4A allows the refrigerant to be out into the cavities 41 and to effect a much faster heat transfer through the fins 40 during both the heating cycle and the cooling cycle. The heat transfer in turn depends on the efficiency of the refrigeration system during its reverse cycles. Thus the exit time for each ice cube from its pocket 20 may be a very few seconds depending on the factors involved.

The instant that the ice cubes have completely moved out from the evaporator 18, the solenoid of the valve 86 is energized (or de-energized) by the switch 87, stopping the hot gas circulation and allowing the refrigeration apparatus to resume its freezing mode and function.

In the practice of the method and in the operation of the apparatus as above described, the evaporator 18 is supplied with water and turned on to start the refrigeration apparatus. The water sump 36 is filled with water which travels through the pipe 38 to be recirculated by the circulating pump and travels through the pipe 30 into the spray pipe 32 to be distributed on the plate 34 and flow downwardly over the fins 40. The freezing action of the evaporator 18 and the walls of the pocket 20 first chill the water in the circulating system and then begins to freeze ice within the pockets 20, as previously described.

The refrigeration system may be cycled on a designated time period for: (a) a freezing cycle to freeze ice in each pocket 20; and (b) a reverse cycle to heat the walls of each pocket 20.

A conventional electrical system (not shown) actuates the solenoid 86 by means of the switch 87 and also stops the circulating pump after a prescribed freezing time, 4–9 minutes for example. Concurrently, or a few seconds thereafter, the vibration transducer 26 is actuated by means of switch 77 to begin vibrating the evaporator 18 as previously described. Hot gas is being circulated through the evaporator 18 to heat the pockets 20 to form a film of water between the ice blocks and the pocket walls 40 and the base 42. The pump is off. After a short period, 30–90 seconds, being an example, the heat has generated enough water between the walls 40 and each ice cube to start the ice cubes to be agitated and to slide out of its pocket 20. The vents 50 allow atmospheric pressure behind the ice cubes to break the vacuum tending to be formed. Any water which has frozen over to plug the vents 20 is the very first to be melted. The switch actuations as described are made through a conventional electric timer (not shown) as part of the electrical system.

After the ice is released from the pockets 20 and the freezing cycle is to be resumed, the controller stops the vibrator transducer 26 and diverts the valve 86 back to the freezing mode. The pump is energized to start the water circulation from the spray header 32 and the refrigeration cycle is resumed.

The refrigeration apparatus again is freezing and the water again is being frozen into ice within the freezer pockets 20 for the succeeding cooling freezing cycle. This cycle of making and ejecting ice continues so long as water is supplied and the refrigeration apparatus with its electrical controls continue in operation.

It is to be noted that the thin film of water coating (on the ice block when the ice blocks are initially released from the freezer pockets 20) quickly becomes "dry". The ice blocks, after ejection from the freezer pockets 20, become dry because the heat in the water phase is very quickly absorbed into the remainder of the ice block which in and of itself has remained at a subfreezing temperature.

It is to be noted that changes and modification of some substance may be made to the embodiments of the invention as herein illustrated and described, all without departing from the spirit and purview of the invention as defined in the appended claims.

That being claimed is:

1. A continuing method for making individual blocks of ice comprising:

(a) flowing chilled water over the openings of ice freezing pockets with the respective bases of such pockets being vertically arranged on a common plane as the base wall of the freezing evaporator and with a plurality of side walls extending outwardly and slightly flared relation to join together as an apex to form a cavity between the walls of adjacent freezer pockets;

(b) allowing said chilled water coming into contact with said base and said fins to freeze and build up ice to fill said pockets and form ice blocks in a freezing cycle during a designated time period, said ice blocks being at a temperature substantially below freezing;

(c) causing said ice pockets and said freezer evaporator to be heated for a designated time period to melt only the immediate surfaces between each pocket side and the enclosed ice block;

(d) vibrating said ice pockets and said freezing evaporator for a designated time period concurrent with the heating time period; and (e) again flowing chilled water over said ice pocket during said subsequent freezing cycle.

2. The method of claim 1 further including providing air to come into each said pocket adjacent to the base of said pocket to break any vacuum formed between said ice pocket and said base and consequently cause said block to slide down a flared side wall of said pocket and out of said pocket during said vibrating cycle.

3. The method of claim 1 wherein said ice freezing pockets are disposed along the walls of a freezing refrigerator evaporator to form a matrix.

4. The method of claim 1 wherein the step of vibrating said ice pockets produces ultrasonic frequencies.

5. The method of claim 1 where the step of vibrating said ice pockets produces subsonic frequencies.

6. An apparatus for repetitively making individual ice blocks comprising:

(a) a plurality of vertically disposed ice freezing pockets which are formed along a side wall of a freezing evaporator as the base of each pocket of said pockets;

(b) a plurality of spaced apart fins formed with each base of said pockets and extending outwardly in slightly flared relation to join together as apexes to form a cavity between adjacent walls of said freezer pockets;

(c) refrigeration means to freeze said bases and said walls of said pockets to temperatures substantially below the freezing temperature of ice;

(d) means for circulating chilled water over the openings of said pockets;

(e) means for operating said refrigeration means through a freezing cycle sufficient to allow said chilled water coming into contact with said base and said fins and build up as ice to fill said pockets and form ice blocks;

(f) means for operating said refrigeration means through a heating cycle sufficiently to melt only the immediate surfaces of said ice blocks which are in contact with surfaces within each freezer pocket; and (g) vibrating transducer means connected to said freezing evaporator for vibrating said freezer means through a cycle concurrent with said heating cycle and consequently cause said ice block to move out of said pocket very rapidly.

7. The apparatus of claim 6 including breather vent means formed in each ice pocket of said ice pockets to cause air to come into each ice pocket adjacent to the base of said ice pocket to break any vacuum between said ice block and said base and consequently aid said ice block to slide down said flared side wall.

8. The apparatus of claim 6 wherein the side walls of said freezer may be formed respectively linear or circular in shape.

9. The apparatus of claim 6 wherein said freezer evaporator is comprised of said pockets connected together with spacer means joined together as a unit with solder such that refrigerant is present in the cavities between said pocket walls as well as between said bases and wherein said means operating said refrigeration means through a heating cycle includes solenoid valve means operable to divert compressed refrigerant directly into said freezer evaporator.

10. The apparatus of claim 6 wherein said vibrating transducer means produces ultrasonic frequencies.

11. The apparatus of claim 6 wherein said vibrating transducer creates subsonic frequencies.

* * * * *